US007794069B2

(12) United States Patent
Sugahara

(10) Patent No.: US 7,794,069 B2
(45) Date of Patent: Sep. 14, 2010

(54) INK CARTRIDGES

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 825 days.

(21) Appl. No.: 11/693,713

(22) Filed: Mar. 30, 2007

(65) Prior Publication Data

US 2007/0236546 A1 Oct. 11, 2007

(30) Foreign Application Priority Data

Apr. 6, 2006 (JP) ..... 2006-104795

(51) Int. Cl.
*B41J 2/175* (2006.01)

(52) U.S. Cl. ..... 347/86

(58) Field of Classification Search ..... 347/7, 347/85–87

See application file for complete search history.

(56) References Cited

U.S. PATENT DOCUMENTS

| | | | | |
|---|---|---|---|---|
| 5,844,579 | A * | 12/1998 | Barinaga et al. | 347/7 |
| 6,286,921 | B1 | 9/2001 | Ochi et al. | |
| 6,293,143 | B1 * | 9/2001 | Denton et al. | 73/293 |
| 6,390,578 | B1 * | 5/2002 | Koitabashi et al. | 347/7 |

FOREIGN PATENT DOCUMENTS

| | | | |
|---|---|---|---|
| JP | H06-312514 | A | 11/1994 |
| JP | H09-001819 | A | 1/1997 |
| JP | 2001-301191 | A | 10/2001 |

* cited by examiner

*Primary Examiner*—An H Do
(74) *Attorney, Agent, or Firm*—Baker Botts L.L.P.

(57) ABSTRACT

An ink cartridge includes an ink chamber configured to store ink and a light blocking layer disposed within the ink chamber. The light blocking layer is fluid and is insoluble to the ink, which may be a water-based ink. A density of the light blocking layer is less than a density of ink stored in the ink chamber. The light blocking layer may comprise an oil or a plurality of particles.

9 Claims, 7 Drawing Sheets

INK CARTRIDGES

CROSS REFERENCE TO RELATED APPLICATION

The present application claims priority to and the benefit of Japanese Patent Application No. 2006-104795, which was filed on Apr. 6, 2006, the disclosure of which is incorporated herein by reference in its entirety.

BACKGROUND OF THE INVENTION

1. Field of the Invention

The present invention relates to ink cartridges configured to store ink.

2. Description of Related Art

Known inkjet printers perform printing by ejecting ink from a print head onto a recording medium. Ink cartridges are often removably mounted to known inkjet printers. If a print head tries to eject ink from an empty ink cartridge, air may enter into the print head, which may lead to printing failures. Moreover, the print head can be ruined from the entry of air therein. To prevent such a situation, an ink level of an ink cartridge has to be constantly monitored in order to stop ink ejection from the print head before the ink cartridge is empty.

For example, a flat float having a lower density than ink may be disposed within an ink chamber of an ink cartridge. The position of the float changes according to the ink level in the ink chamber. Thus, it can be determined that cartridge is substantially empty of ink by detecting the position of the float.

In the known ink cartridge, the float may not lower as the ink level falls if the float sticks to an inner wall surface of the ink chamber. The surface tension of ink adhering to the inner surface of the ink cartridge, or some other disturbance, may cause the float to stick. Accordingly, an ink level of the ink cartridge may not be detected accurately.

SUMMARY OF THE INVENTION

Therefore, a need has arisen for ink cartridges, which overcome these and other shortcomings of the related art. A technical advantage of the present invention is that a residual ink level of an ink cartridge is detected accurately.

An ink cartridge comprises an ink chamber configured to store ink and a light blocking layer disposed within the ink chamber. The light blocking layer has fluidity and is insoluble to ink stored in the ink chamber. A density of the light blocking layer is less than a density of ink stored in the ink chamber.

The ink stored in the ink chamber may be a water-based ink. The light blocking layer may comprise oil, which may be colored by a dye or pigment, or a plurality of particles.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description in view of the accompanying drawings.

DETAILED DESCRIPTION OF EMBODIMENTS OF THE INVENTION

Figure 1:
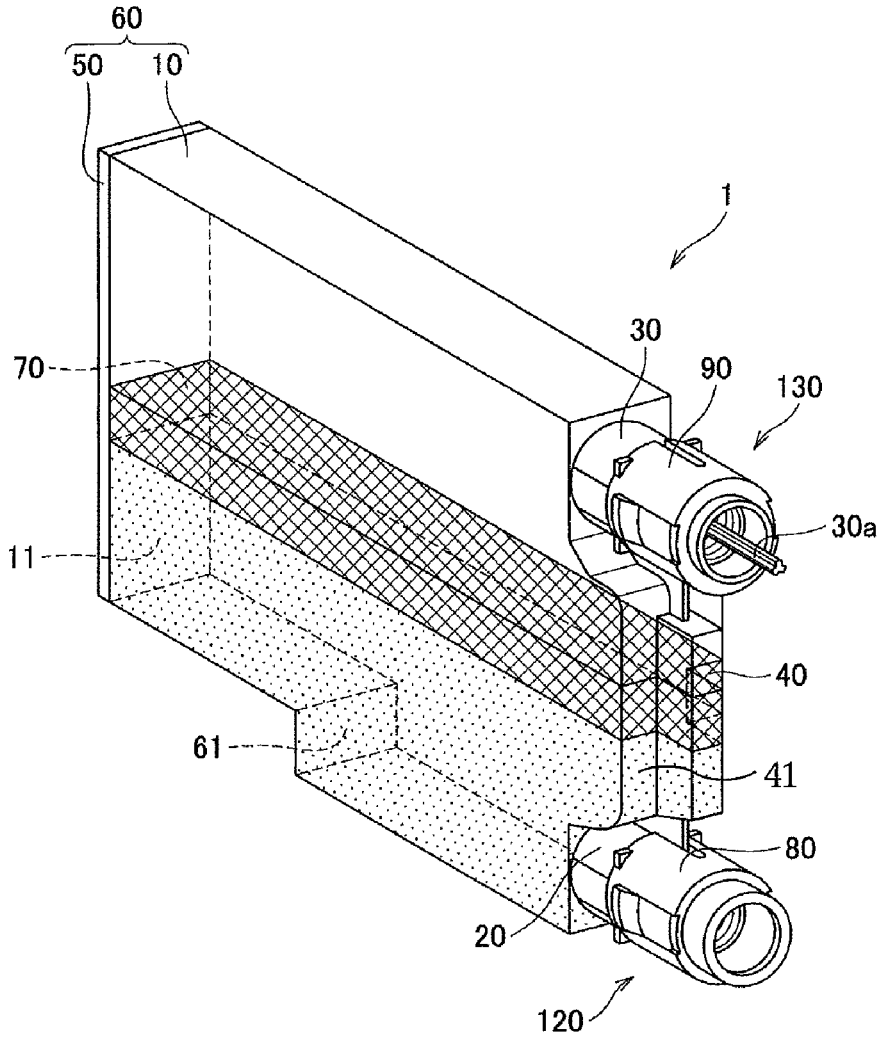
FIG. 1 is a perspective view of an ink cartridge according to an embodiment of the present invention.

Embodiments of the present invention, and their features and advantages, may be understood by referring to FIGS. 1-7, like numerals being used for like corresponding parts in the various drawings.

Referring to FIGS. 1-4B, an ink cartridge 1 according to an embodiment of the invention may be of a substantially hexahedron shape having six faces. More specifically, ink cartridge 1 may comprise a pair of opposing faces, each having a substantially rectangular shape and the largest area among the faces of ink cartridge 1, and four connecting faces that connect between the largest opposing faces.

Ink cartridge 1 may comprise an ink chamber 60 configured to store ink and a light blocking layer 70 disposed within ink chamber 60. Ink chamber 60 comprises a box-shaped case 10 with a main opening 11 and a lid 50 closing main opening 11. Light blocking layer 70 may comprise oil.

Case 10 and lid 50 may be manufactured by, for example, injection molding using resin material, such as polypropylene. Case 10 and lid 50 may be sealed tightly to prevent ink leaking from ink chamber 60. Ink chamber 60 may be translucent and store water-based translucent ink.

Figure 4A:
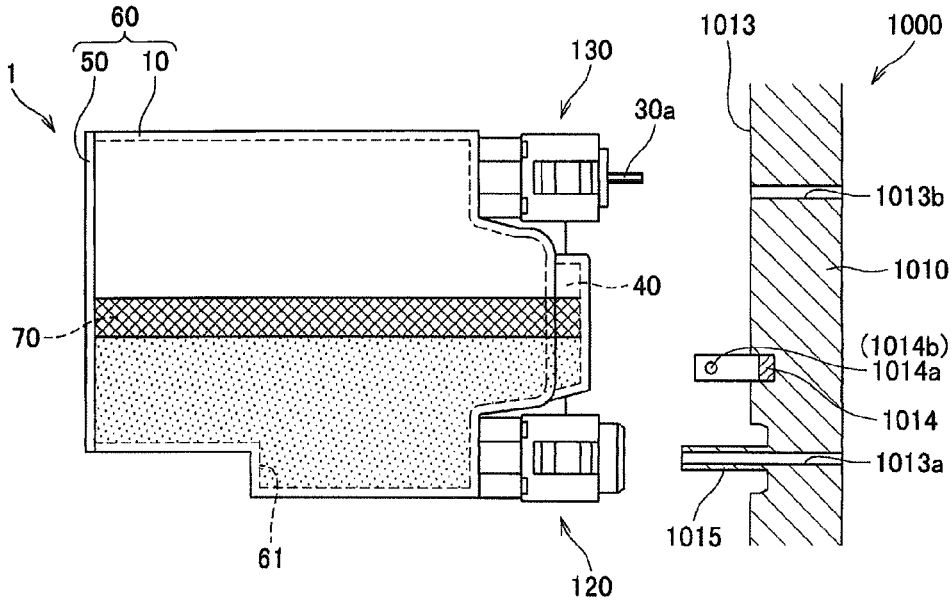
FIGS. 4A and 4B are schematics showing processes of mounting the ink cartridge of FIG. 1 to an inkjet printer.
Figure 4B:
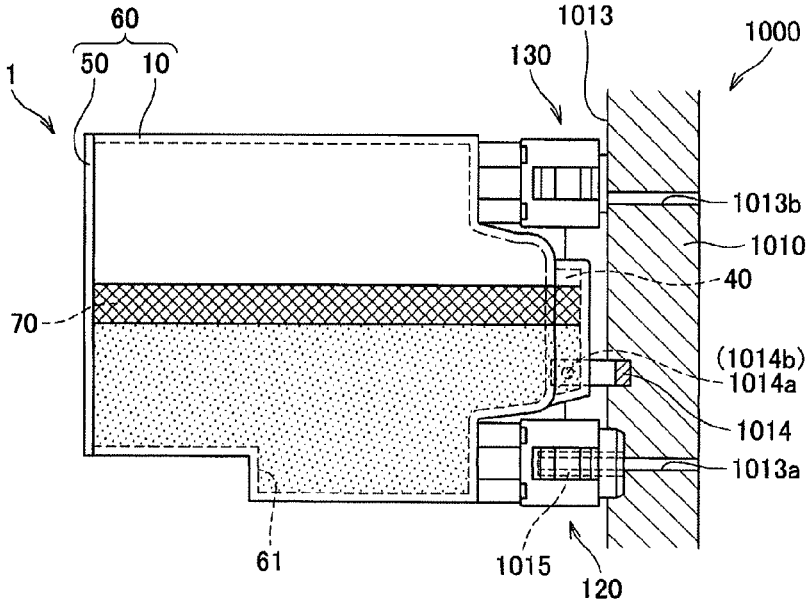

Ink cartridge 1 may comprise an ink supply path 120 and an air introduction path 130. Ink supply path 120 is configured to supply ink from ink chamber 60 to an exterior of ink cartridge 1, more specifically, to an inkjet printer 1000, as shown in FIGS. 4A and 4B. Air introduction path 130 is configured to introduce air into ink chamber 60 from an exterior of ink cartridge 1.

Figure 2:
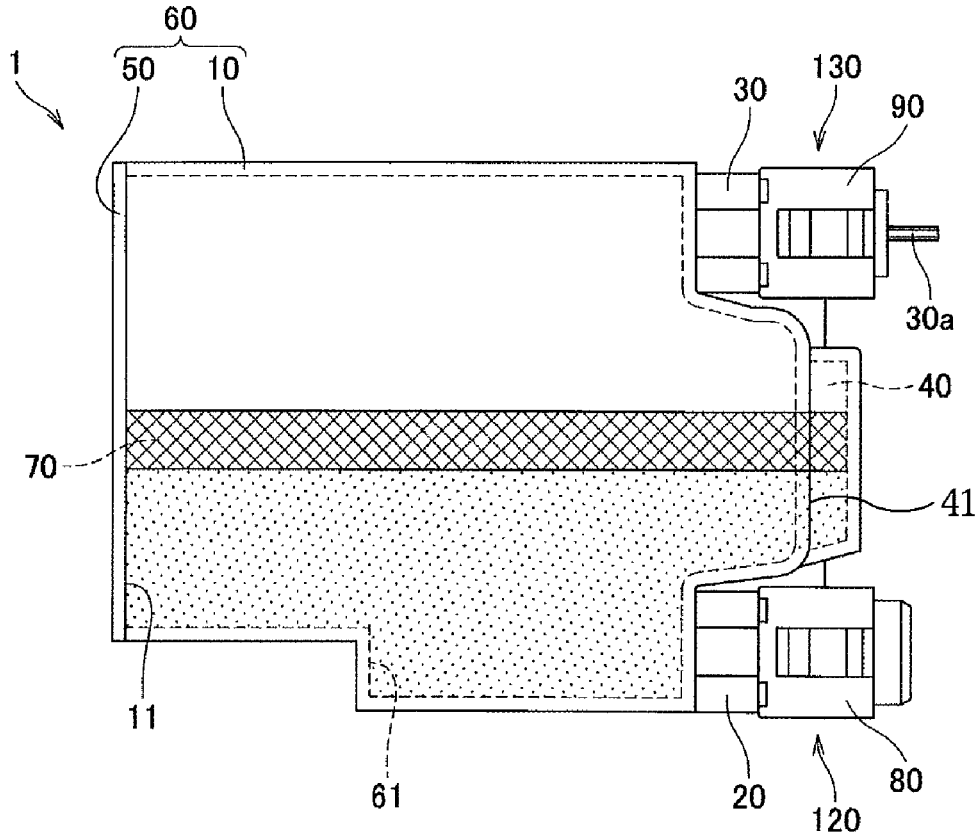
FIG. 2 is a plan view of the ink cartridge of FIG. 1.

Ink cartridge 1 may be mounted to inkjet printer 1000 in the orientation shown in FIGS. 1 and 2. More specifically, ink cartridge 1 may be mounted to inkjet printer 1000 to engage ink supply path 120 and air introduction path 130 on lower and upper ends of ink cartridge 1, respectively, while the largest faces of ink cartridge 1 are placed substantially vertically and their longitudinal direction is parallel to the horizontal direction. In the following description, the top, bottom, upper and lower sides of ink cartridge 1, as well as its vertical orientation are defined in conjunction with the orientation in which ink cartridge 1 is mounted to inkjet printer 1000, as shown in FIGS. 4A and 4B.

Ink supply path 120 may comprise an ink supply passage 20 and an ink supply mechanism 80. Ink supply passage 20 may be disposed on a lower end of a face opposite main opening 11 to communicate with ink chamber 60. Ink supply passage 20 may be of a cylindrical shape extending in the longitudinal direction of ink cartridge 1. A portion of ink supply mechanism 80 is fitted to ink supply passage 20.

Air instruction path 130 may comprise an air communication passage 30 and an air introduction mechanism 90. Air communication passage 30 may be disposed on an upper end of the face opposite main opening 11 to communicate with ink chamber 60. Air communication passage 30 also may be of a cylindrical shape extending in the longitudinal direction of ink cartridge 1. A portion of air introduction mechanism 90 is fitted to air communication passage 30.

When ink cartridge 1 is not mounted to inkjet printer 1000, ink supply mechanism 80 closes an ink passage. When ink cartridge 1 is mounted to inkjet printer 1000, ink passage opens when an ink extracting tube 1015 (in FIG. 4A) is inserted into ink supply mechanism 80. Thus, ink supply path 120 allows ink from ink chamber 60 to be supplied to inkjet printer 1000 when ink cartridge 1 is mounted to inkjet printer 1000.

Air introduction mechanism 90 has a bar 30*a* that extends outwardly from air introduction mechanism 90. When ink cartridge 1 is not mounted to inkjet printer 1000, air introduction mechanism 90 closes an air passage. When ink cartridge 1 is mounted to inkjet printer 1000, air introduction mechanism 90 opens the air passage when bar 30*a* contacts a mounting surface 1013 (in FIG. 4A) of inkjet printer 1000 and is pushed toward air communication passage 30. Thus, air introduction path 130 allows the introduction of air into ink chamber 60 when ink cartridge 1 is mounted to inkjet printer 1000.

A detection portion 40 may extend outwardly from an interface wall 41 of case 10 opposite main opening 11 and be positioned between ink supply passage 20 and air communication passage 30. Detection portion 40 has a first end proximate air communication passage 30, and a second end, which is opposite the first end, proximate ink supply passage 20. An interior of detection portion 40 is defined by a pair of opposing sidewalls connecting the first and second ends. A height of detection portion 40 is a distance between the first and second ends, while a width of detection portion 40 is a distance between the opposing sidewalls. As shown in FIG. 1, the width of detection portion 40 is less than the width of interface wall 41. The interior of detection portion 40 communicates with ink chamber 60.

As shown in FIGS. 4A and 4B, when ink cartridge 1 is mounted to inkjet printer 1000, detection portion 40, more specifically, its lower part, may be placed between a light emitting portion 1014*a* and a light receiving portion 1014*b* of an ink level detection sensor 1014, which may be a transmissive optical sensor. In other words, the lower part of detection portion 40 may serve as a detection position at which ink level detection sensor 1014 detects whether a sufficient amount of ink is remaining in ink cartridge 1.

A step portion 61 may be disposed at a substantially central portion of a bottom wall of ink chamber 60 with respect to the longitudinal direction of ink cartridge 1. With step portion 61, the bottom wall of ink chamber 60 adjacent ink supply path 120 is lower than the bottom wall adjacent lid 50. Thus, the arrangement of the bottom wall of ink chamber 60 provides that ink may flow smoothly toward ink supply path 120.

Light blocking layer 70 may comprise oil colored black with dye or pigment. Light blocking layer 70 may have fluidity at least at 20 degrees Celsius and under atmospheric pressure. A density (mass per unit volume) of the oil used for light blocking layer 70 may be lower than a density of ink within ink chamber 60. The oil may be paraffin oil, turpentine oil, or rapeseed oil, or any other suitable oil. The oil may be insoluble to a water-based ink contained in ink chamber 60. Therefore, light blocking layer 70 may float on ink within ink chamber 60 without dissolving, as shown in FIGS. 1 and 2. Therefore, light blocking layer 70 lowers as ink within ink chamber 60 is consumed and the ink level falls. Light blocking layer 70 covers a part of the ink surface that does not contact inner wall surfaces of ink chamber 60. An intensity of light emitted from light emitting portion 1014*a* decreases when passing through light blocking layer 70, and, thus, reduces the intensity of light reaching light receiving portion 1014*b*. Light blocking layer 70 may be even thick enough to reduce the intensity of the light reaching light receiving portion 1014*b* to zero.

Figure 3A:
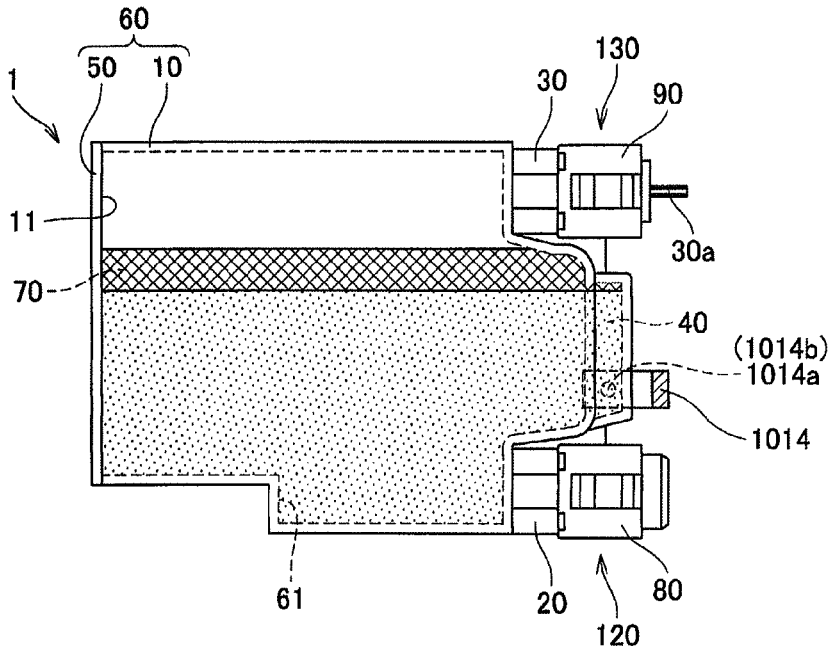
FIGS. 3A and 3B are plan views of the ink cartridges of FIG. 1 showing different amounts of ink remaining in the respective ink cartridges.
Figure 3B:
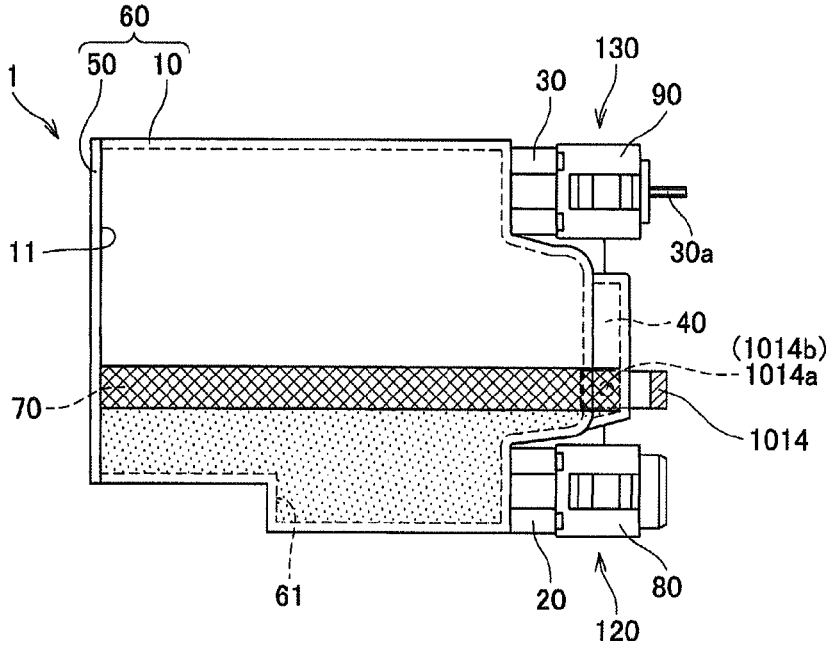

Referring to FIGS. 3A and 3B, detection of an ink level of ink cartridge 1 is described.

In FIG. 3A, a sufficient amount of ink is stored within ink chamber 60. As shown in FIG. 3A, when light blocking layer 70 floating on ink stored within ink chamber 60 is disposed above the detection position of detection portion 40, translucent ink is disposed within the inner space of detection portion 40 at ink level detection sensor 1014. In this state, light passes between light emitting portion 1014*a* and light receiving portion 1014*b*, and if the intensity of the light reaching light receiving portion 1014*b* is equal to or above a predetermined light intensity threshold level then a determining mechanism, e.g., a circuit board (not shown), disposed in inkjet printer 1000 determines that an ink level of ink cartridge 1 is sufficient.

As ink level of ink chamber 60 lowers, light blocking layer 70 floating on top of ink within ink chamber 60 reaches the detection position of detection portion 40, as shown in FIG. 3B. Light blocking layer 70 reduces the intensity of the light emitted from light emitting portion 1014*a* that reaches receiving portion 1014*b* below the threshold level, e.g., zero. In this state, the circuit board of inkjet printer 1000 determines that ink cartridge 1 is in a "near empty" state indicating a low ink level whereby ink cartridge 1 will soon run out of ink.

Referring to FIGS. 4A and 4B, mounting of ink cartridge 1 to inkjet printer 1000 is described.

Ink cartridge 1 is mounted to a mounting portion 1010 of inkjet printer 1000. Ink level detection sensor 1014 may be disposed on mounting portion 1010 at a position to engage detection portion 40. Mounting portion 1010 may have a mounting surface 1013 facing ink cartridge 1 when it is mounted to inkjet printer 1000. Light emitting portion 1014*a* and light receiving portion 1014*b* of ink level detection sensor 1014 may extend from mounting surface 1013 so as to face each other with a distance therebetween. When light emitted from light emitting portion 1014*a* is received by light receiving portion 1014*b*, if the intensity of the received light is equal to or greater than the threshold level, then ink level detection sensor 1014 may not output a signal to the circuit board of inkjet printer 1000. When the intensity of light reaching light receiving portion 1014*b* is reduced by light blocking layer 70, the intensity of the received light may fall below the threshold level and ink level detection sensor 1014 may output a signal to the circuit board of inkjet printer 1000. Alternatively, ink level detection sensor 1014 may output a signal to the circuit board when the intensity of the received light is equal to or above the threshold level, and may not output a signal to the circuit board when the intensity of the received light is below the threshold level.

Ink extracting tube 1015 may protrude from mounting surface 1013 at a position corresponding to ink supply path 120. Ink extracting tube 1015 may communicate with an ink channel 1013*a*. Ink within ink cartridge 1 is supplied to an ink ejection opening formed in a recording head (not shown) of ink jet printer 1000 through ink channel 1013*a*. An air channel 1013*b* also may be formed through mounting portion 1010. Air channel 1013*b* is open at a flat portion of mounting surface 1013 and at a position corresponding to air introduction path 130 when it is mounted to inkjet printer 1000. Air channel 1013*b* is configured to pass air therethrough and into ink chamber 60 of ink cartridge 1.

When ink cartridge 1 is mounted to inkjet printer 1000, as shown in FIG. 4B, ink extracting tube 1015 is inserted into ink supply path 120, bar 30*a* contacts the flat portion of mounting surface 1013, and detection portion 40 is positioned between light emitting portion 1014*a* and light receiving portion 1014*b*. In this state, ink may be supplied from ink cartridge 1, air may be introduced into ink cartridge 1, and the ink level of ink cartridge 1 may be detected.

In ink cartridge 1, even when a part of light blocking layer 70, which has fluidity, adheres to an inner surface of ink chamber 60 due to its surface tension, other parts of light blocking layer 70 remain floating on top of the ink and follow the drop in ink level. Therefore, by detecting a position of light blocking layer 70 that floats on ink, an ink level of ink chamber 60 may be determined accurately.

Ink chamber 60 may store water-based ink. Light blocking layer 70 may comprise oil. Thus, any additional objects or components, e.g., a float, may not have to be provided to detect an ink level of ink chamber 60 engaged with ink level detection sensor 1014. Consequently, costs of producing ink cartridge 1 may be reduced.

As described above, part of the ink surface that does not contact inner wall surfaces of ink chamber 60 is covered with light blocking layer 70, which also may prevent evaporation of ink within ink chamber 60.

Figure 5:
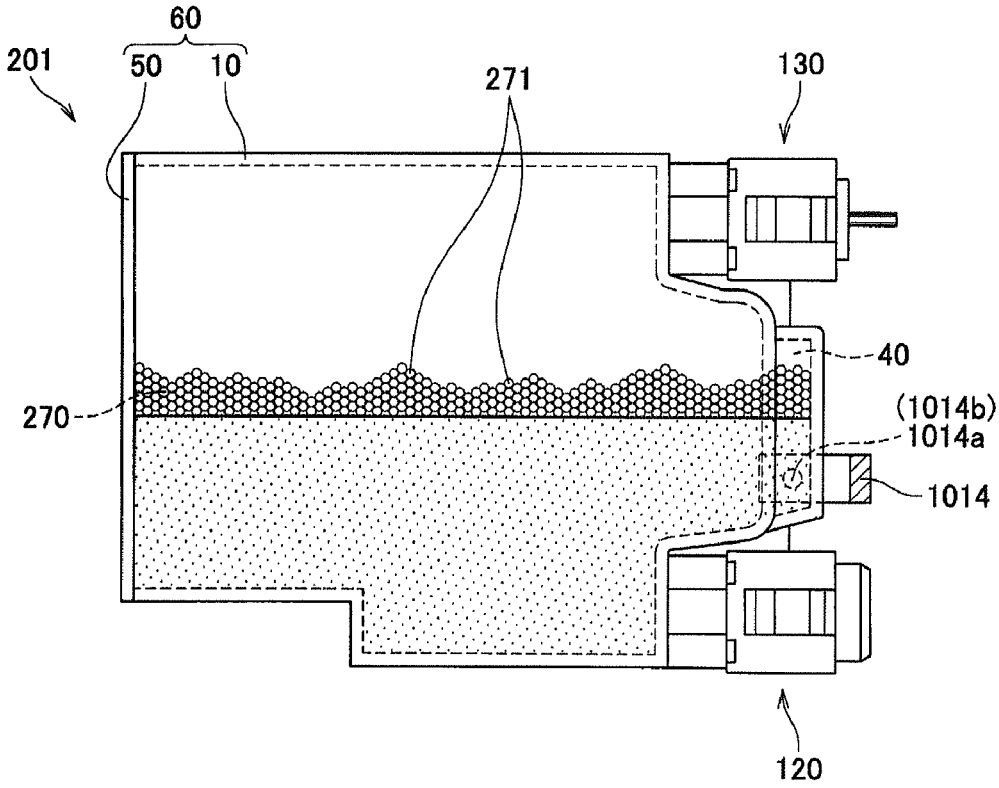
FIG. 5 is a schematic of an ink cartridge according to another embodiment of the present invention.

Referring to FIG. 5, an ink cartridge 201 according to another embodiment of the present invention is described. A structure of ink cartridge 201 may be similar to that of ink cartridge 1. Therefore, only the differences between ink cartridge 201 and ink cartridge 1 are discussed with respect to ink cartridge 201.

In ink cartridge 201, a light blocking layer 270 may be disposed within ink chamber 60. Light blocking layer 270 may comprise a plurality of particles 271, which may be opaque or comprise a material which scatters, deflects, or refracts light. A density of particles 271 may be lower than a density of ink stored within ink chamber 60. Particles 271 may be formed of resin material, such as polyethylene or polypropylene, that has a lower density than that of ink stored within ink chamber 60. For example, a density of general water-based dye ink is approximately 1.07 g/cm$^3$, whereas densities of polyethylene and polypropylene are approximately 0.92 and 0.91 g/cm$^3$, respectively. A diameter of each particle 271 may be approximately from 0.1 mm to 1 mm. Light blocking layer 270 comprising a plurality of particles 271 may have fluidity. As shown in FIG. 5, light blocking layer 270 floats on ink while covering a part of the ink surface that does not contact the inner wall surfaces of ink chamber 60. Light blocking layer 270 lowers as ink within ink chamber 60 is consumed and the ink level falls. Light emitted from light emitting portion 1014*a* may be absorbed, scattered, or refracted when the light passes through light blocking layer 270, which is thick enough to reduce the intensity of the light reaching light receiving portion 1014*b* to below some predetermined light intensity threshold level.

Similar to the above-described embodiment, when the light blocking layer 270 floating on ink in ink chamber 60 is disposed above the detection position in detection portion 40, light passes between light emitting portion 1014*a* and light receiving portion 1014*b*, and the intensity of the light reaching light receiving portion 1014*b* is equal to or above the threshold level so that the circuit board of inkjet printer 1000 determines that the ink level of ink cartridge 1 is sufficient.

As light blocking layer 270, floating on top of ink stored within ink chamber 60, reaches the detection position of detection portion 40, light blocking layer 270 reduces the intensity of the light emitted from light emitting portion 1014*a* that reaches receiving portion 1014*b* below the threshold level, e.g., zero, so that the circuit board of inkjet printer 1000 determines that ink cartridge 1 is in a "near empty" state.

In ink cartridge 201, even when a part of light blocking layer 270, which has fluidity, adheres to an inner surface of ink chamber 60 due to its surface tension, other parts of light blocking layer 270 float on top of the ink stored within ink chamber 60 and follow the drop in ink level. Therefore, by detecting a position of light blocking layer 270 that floats on ink, an ink level of ink chamber 60 may be determined accurately, similar to ink cartridge 1.

Light blocking layer 270 comprises a plurality of particles 271. Therefore, as compared with an oil light blocking layer, light blocking layer 270 may reduce any chemical influences on ink stored within ink cartridge 201.

Figure 6:
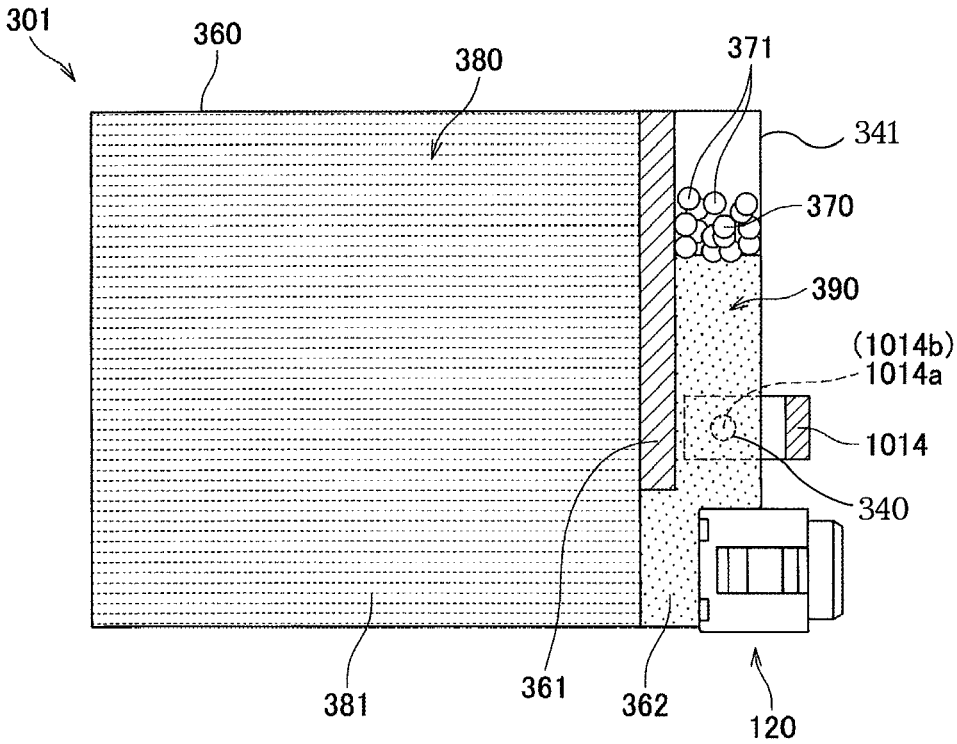
FIG. 6 is a schematic of an ink cartridge according to yet another embodiment of the present invention.

Referring to FIG. 6, an ink cartridge 301 according to yet another embodiment of the present invention is described. A structure of ink cartridge 301 may be similar to that of ink cartridge 1. Therefore, only the differences between ink cartridge 301 and ink cartridge 1 are discussed with respect to ink cartridge 301.

Ink cartridge 301 may comprise an ink chamber 360, which may be divided by a partition wall 361 into a first chamber 380 and a second chamber 390. Ink cartridge 301 comprises an interface wall 341, and an ink supply path 120 is formed at the interface wall 341 and is configured to supply ink from second chamber 390 to the exterior of ink cartridge 301. Interface wall 341 has a first end and a second end, opposite the first end. Ink supply path 120 is positioned closer to the second end of interface wall 341 than to the first end. A height of second chamber 390 may extend between the first end and the second end of interface wall 341. When ink stored within second chamber 390 is supplied through ink supply path 120, the level of the ink of second chamber 390 may move in the height direction. Partition wall 361 may be disposed adjacent to interface wall 341 of ink cartridge 301, and second chamber 390 is provided between partition wall 361 and interface wall 341.

A porous member 381 may be disposed within first chamber 380, and porous member 381 is configured to absorb ink. Porous member 381 may comprise, for example, foamed polyurethane resin. A space 362 may be provided between the bottom wall of ink chamber 360 and the lower end of partition wall 362. Space 362 provides fluid communication between first chamber 380 and second chamber 390. More specifically, ink flows from first chamber 380 through space 362 to second chamber 390. An air introduction path may be formed at the top wall of first chamber 380.

A light blocking layer 370 comprising a plurality of particles 371 may be disposed within second chamber 390. Particles 371 may be similar to particles 271 and may be opaque or comprise a material which scatters, deflects, or refracts light. Moreover, a density of particles 371 may be lower than a density of ink stored within ink chamber 360 to permit light blocking layer 370 to float on ink within second chamber 390. Light blocking layer 370 comprising particles 371 may have fluidity. Light blocking layer 370 lowers as ink within second chamber 390 is consumed and the ink level falls. As with light blocking layers 70, 270, light blocking layer 370 is thick enough to reduce the intensity of the light reaching light receiving portion 1014*b* to below some predetermined light intensity threshold level. Light blocking layer 370 may be even thick enough to reduce the intensity of the light reaching light receiving portion 1014*b* to zero.

When ink cartridge 301 is mounted to inkjet printer 1000, a lower part of second ink chamber 390 may be placed between light emitting portion 1014*a* and light receiving portion 1014*b* and serve as a detection portion 340. Similar to ink chamber 60, ink chamber 360 may be translucent and may store water-based translucent ink.

When light blocking layer 370 floating on ink stored within second chamber 390 is disposed above the detection portion 340, light passes between light emitting portion 1014*a* and light receiving portion 1014*b*, and the intensity of the light reaching light receiving portion 1014*b* is equal to or above the threshold level so that the circuit board of inkjet printer 1000 determines that an ink level of ink cartridge 1 is sufficient. When light blocking layer 370 reaches the detection portion 340, light blocking layer 370 reduces the intensity of the light reaching receiving portion 1014*b* below the threshold level, e.g., zero, so that the circuit board of inkjet printer 1000 determines that ink cartridge 301 is in the "near empty" state.

In ink cartridge 301, even when a part of light blocking layer 370, which has fluidity, adheres to an inner surface of ink chamber 360 or partition wall 361 due to its surface tension, other parts of light blocking layer 370 float on ink and follow the drop of the ink level. Therefore, by detecting a position of light blocking layer 370 that floats on ink, an ink level of ink chamber 360 may be determined accurately, similar to ink cartridges 1 and 201.

An area of light blocking layer 370 contacting ink stored within second chamber 390 is relatively smaller than the area of light blocking layers 70, 270 contacting ink stored within non-partitioned ink chamber 60. Thus, any chemical influences caused by light blocking layer 370 on ink stored within ink cartridge 301 may be reduced.

For example, even when ink cartridge 301 is inverted, particles 371 of light blocking layer 370 may not enter first chamber 380, having porous member 381 therein, through space 362. Therefore, reduction of particles comprising light blocking layer 370 may be prevented by limiting the leakage of particles 371 from second chamber 390 to first chamber 380. As a result, even when an amount of material comprising light blocking layer 370 is relatively small, an ink level of ink cartridge 301 may be detected accurately.

Further, because light blocking layer 370 comprises particles 371, ink cartridge 301 may reduce chemical influences on ink stored therein, as compared with, for example, an oil light blocking layer.

Figure 7:
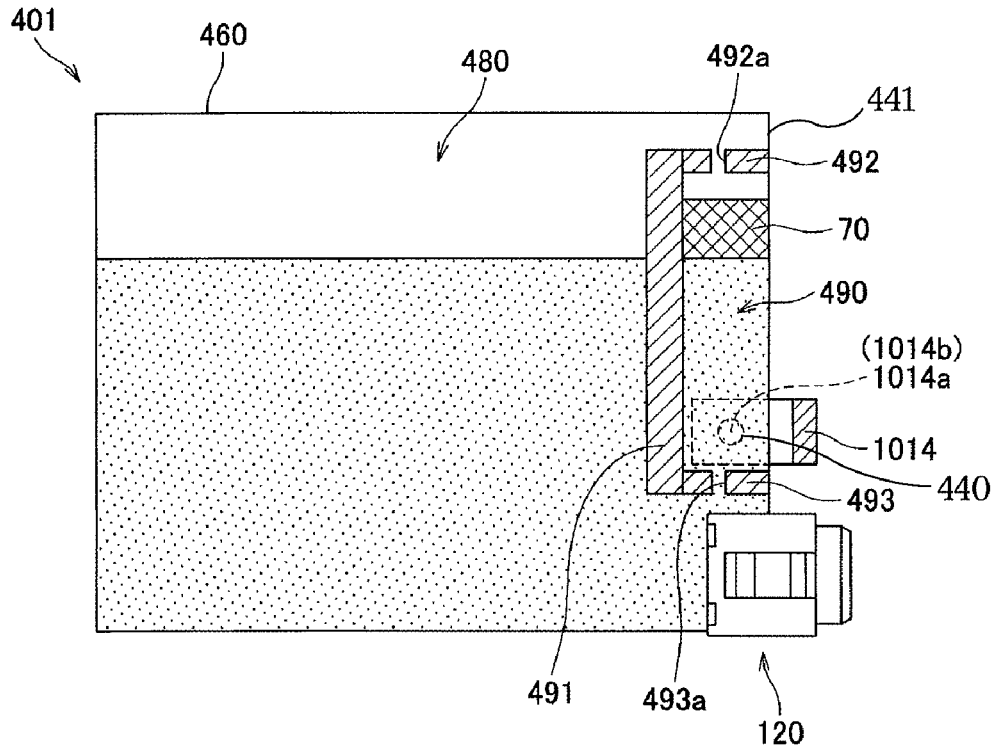
FIG. 7 is a schematic of an ink cartridge according to still yet another embodiment of the present invention.

Referring to FIG. 7, an ink cartridge 401 according to still yet another embodiment of the present invention is described. A structure of ink cartridge 401 may be similar to that of ink cartridge 1. Therefore, the only differences between ink cartridge 401 and ink cartridge 1 are discussed with respect to ink cartridge 401.

Ink cartridge 401 may comprise an ink chamber 460, which may comprise a first chamber 480 and a second chamber 490. Ink cartridge 401 comprises an interface wall 441, and an ink supply path 120 is formed at the interface wall 441 and is configured to supply ink from ink chamber 460 to the exterior of ink cartridge 401. Interface wall 441 has a first end and a second end, opposite the first end. Ink supply path 120 is positioned closer to the second end of interface wall 441 than to the first end. Interface wall 441 may extend in a height direction between the first end and the second end. When ink stored within ink chamber 460 is supplied through ink supply path 120, the level of the ink of second chamber 490 may move in the height direction. Partition wall 491 may be disposed adjacent to interface wall 441, and second chamber 490 is provided within partition wall 491, interface wall 441, and upper and lower walls 492, 493, which may extend from the first and second ends of partition wall 491, respectively, to interface wall 441. An area of ink chamber 460 outside of second chamber 490 is defined as first chamber 480. Second chamber 490 may extend along the height direction of interface wall 441 from upper wall 492 to lower wall 493.

Communication holes 492*a*, 493*a* may be formed in, e.g., at or on, upper and lower walls 492, 493 respectively. An area of each communication hole 492*a*, 493*a* may be smaller than a cross-sectional area of second chamber 490 taken along the direction perpendicular to the height direction of interface wall 441. Second chamber 490 communicates with first chamber 480 via communication holes 492*a*, 493*a*. Light blocking layer 70, similar to that in the above embodiment, may comprise oil disposed within second chamber 490. Light blocking layer 70, which floats on ink in second chamber 490, lowers as ink within ink chamber 460 is consumed and the ink level falls.

When ink cartridge 401 is mounted to inkjet printer 1000, a lower part of second chamber 490 may be placed between light emitting portion 1014*a* and light receiving portion 1014*b* to serve as a detection portion 440. Similar to ink chamber 60, ink chamber 460 may be translucent and may store water-based translucent ink.

Similar to the above-described embodiments, when light blocking layer 70 floating on ink within second chamber 490 is disposed above the detection portion 440, light passes between light emitting portion 1014*a* and light receiving portion 1014*b*. Thus, the intensity of the light reaching light receiving portion 1014*b* is equal to or above the predetermined light intensity threshold level so that the circuit board of inkjet printer 1000 determines that an ink level of ink cartridge 401 is sufficient. As light blocking layer 70 reaches detection portion 440, light blocking layer 70 reduces the intensity of the light reaching receiving portion 1014*b* below the threshold level, e.g., zero, so that the circuit board of inkjet printer 1000 determines that ink cartridge 401 is in the "near empty" state.

Thus, an ink level of ink cartridge 401 may be detected accurately, similar to ink cartridges 1, 201, and 301. Even when a part of light blocking layer 70, which has fluidity, adheres to an inner surface of ink chamber 460 or partition wall 491, due to its surface tension, other parts of light blocking layer 270 remain floating on top of the ink and follow the drop in ink level.

Similar to light blocking layer 370, an area of light blocking layer 70 of ink cartridge 401 contacting ink within second chamber 490 is relatively smaller than that of light blocking layers 70, 270 contacting ink stored within non-partitioned ink chamber 60. Thus, any chemical influences caused by light blocking layer 70 on ink stored within ink cartridge 401 may be reduced.

As described above, an area of each communication hole 492*a*, 493*a* is smaller than a cross-sectional area of second chamber 490. Therefore, leakage of the oil comprising light blocking layer 70 from second chamber 490 toward first chamber 480 may be prevented. Therefore, a reduction of light blocking layer 70 caused by such leakage also may be prevented. Therefore, an ink level of ink cartridge 401 may be detected accurately at detection portion 440.

According to the above-described embodiments, ink level detection sensor 1014 detects light blocking layer 70, 270, 370 at a predetermined height. Light blocking layers 70, 270, 370, however, may be detected at different heights, so that an ink level of an ink cartridge may be detected more accurately.

Light blocking layers 70, 270, 370 may comprise hollow particles formed of, for example, resin or glass. The hollow particles may reduce the density of the light blocking layer, so that differences in density between the light blocking layer and ink may increase. Thus, the separation characteristics of the light blocking layer from ink may be improved and the mixing of ink with the light blocking layer may be reduced.

Ink-level detection sensor 1014 is not limited to transmissive-type sensor. For example, a reflective-type sensor may be used to detect light blocking layers 70, 270, 370. The reflective-type sensor may comprise a light emitting portion and a light receiving portion configured to receive light that is emitted from the light emitting portion and is reflected at a light blocking layer.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the embodiments disclosed herein. It is intended that the specification and the described examples are illustrative with the true scope of the invention being defined by the following claims.

What is claimed is:

1. An ink cartridge, comprising:

an ink chamber configured to store ink, the ink chamber comprises:

a first chamber; and a second chamber comprising:

a first end;

a second end opposite to the first end, the second chamber extends in a height direction from the first end to the second end;

a first communication hole formed in the first end; and a second communication hole formed in the second end;

a light blocking layer disposed within the second chamber of the ink chamber; and an ink supply path configured to supply ink stored in the ink chamber to an exterior of the ink cartridge, wherein the light blocking layer has fluidity and is insoluble to ink stored in the ink chamber, wherein a density of the light blocking layer is less than a density of ink stored in the ink chamber, wherein the second chamber is in fluid communication with the first chamber via each of the first communication hole and the second communication hole, wherein a level of ink stored in the second chamber moves in the height direction in accordance with a change of an amount of ink stored in the second chamber when ink is supplied from the ink chamber to the exterior of the ink cartridge, and wherein an area of each of the first communication hole and the second communication hole is smaller than a cross-sectional area of the second chamber taken along a direction perpendicular to the height direction.

2. The ink cartridge according to claim 1, wherein ink stored in the ink chamber is a water-based ink and the light blocking layer comprises an oil.

3. The ink cartridge according to claim 2, wherein the light blocking layer is a black layer and further comprises at least one of a dye or a pigment.

4. The ink cartridge according to claim 1, wherein the light blocking layer comprises a plurality of particles.

5. The ink cartridge according to claim 4, wherein the particles are hollow.

6. The ink cartridge according to claim 5, wherein the hollow comprise at least one of resin or glass.

7. The ink cartridge according to claim 4, wherein the particles are opaque.

8. The ink cartridge according to claim 1, wherein the light blocking layer covers a surface of ink stored in the ink chamber that does not contact an inner wall surface of the ink chamber.

9. The ink cartridge according to claim 1, wherein the ink chamber further comprises a porous member disposed within the first chamber, wherein the ink supply path is configured to supply ink from the second chamber to the exterior of the ink cartridge.

* * * * *